US010036566B2

(12) United States Patent
Vanden Bosch

(10) Patent No.: US 10,036,566 B2
(45) Date of Patent: Jul. 31, 2018

(54) VENT COVER

(71) Applicant: P-Tec Products, Inc., Zeeland, MI (US)

(72) Inventor: Kalvin K. Vanden Bosch, West Olive, MI (US)

(73) Assignee: P-Tec Products, Inc., Zeeland, MI (US)

( * ) Notice: Subject to any disclaimer, the term of this patent is extended or adjusted under 35 U.S.C. 154(b) by 864 days.

(21) Appl. No.: 14/504,990

(22) Filed: Oct. 2, 2014

(65) Prior Publication Data

US 2015/0105012 A1 Apr. 16, 2015

Related U.S. Application Data

(60) Provisional application No. 61/889,825, filed on Oct. 11, 2013.

(51) Int. Cl.
*F24F 7/02* (2006.01)
*F24F 11/75* (2018.01)

(52) U.S. Cl.
CPC ..... *F24F 7/02* (2013.01); *F24F 11/75* (2018.01)

(58) Field of Classification Search
CPC ..... F24F 11/047; F24F 7/02; F24F 11/75
USPC ..... 454/275
See application file for complete search history.

(56) References Cited

U.S. PATENT DOCUMENTS 2,224,312 A 12/1940 O'Day
2,332,552 A * 10/1943 Belanger ..... F04D 25/14 454/353
2,770,833 A 11/1956 Drechsel
3,171,343 A 3/1965 Wexler
3,182,580 A * 5/1965 Jueng ..... F24F 7/02 454/363
3,842,722 A 10/1974 Miller
3,937,133 A 2/1976 Bertin et al.
4,151,789 A 5/1979 Grobard
4,334,461 A 6/1982 Ferguson et al.
4,621,569 A * 11/1986 Fioratti ..... A01K 1/0058 454/364
4,815,362 A 3/1989 Ishizuka et al.
5,046,408 A 9/1991 Eugenio
(Continued)

FOREIGN PATENT DOCUMENTS

EP 0267485 10/1987
FR 2654198 5/1991

*Primary Examiner* — Alissa Tompkins
*Assistant Examiner* — Frances F Hamilton
(74) *Attorney, Agent, or Firm* — Gardner, Linn, Burkhart & Ondersma LLP

(57) ABSTRACT

A vent cover is configured for attachment to a downwardly-facing surface, such as a soffit panel of a building roof overhang. The vent cover includes a housing coupled to a base portion, the housing defining a fluid discharge outlet and fluid passageway, with the outlet being selectively blocked by at least one movable door. The door is hinged at its upper end portion and is biased to a closed position by gravity. A sufficiently high air pressure will raise the door and permit an outflow of air through the discharge outlet. Where separate inner and outer doors are provided, the outer door may be manually movable to its open position while the inner door remains closed, so that the inner door continues to restrict access to an interior of the housing.

19 Claims, 3 Drawing Sheets

(56) References Cited

U.S. PATENT DOCUMENTS 5,088,388 A * 2/1992 Schaefer ..... F24F 13/1413 454/270
5,236,391 A * 8/1993 Schaefer ..... A01K 1/0064 454/253
5,383,816 A * 1/1995 Marcello ..... F24F 7/013 454/359
5,662,522 A 9/1997 Waltz
5,692,955 A * 12/1997 Meyer ..... F24F 13/06 454/353
5,722,181 A 3/1998 Meyer
5,762,551 A * 6/1998 Lachapelle ..... F24F 7/02 137/512.2
5,765,319 A 6/1998 Callaghan, Jr.
5,766,073 A * 6/1998 O'Kelley ..... F24F 7/013 454/354
5,916,023 A 6/1999 Meyer
5,989,119 A * 11/1999 Raisanen ..... A01K 1/0052 454/239
6,125,839 A * 10/2000 Elgowainy ..... F23C 7/00 126/85 B
6,165,065 A 12/2000 Pasij
6,213,868 B1 * 4/2001 Sells ..... E04D 13/174 454/359
6,293,862 B1 9/2001 Jafine et al.
6,302,788 B1 10/2001 Gagnon
6,361,433 B1 3/2002 Gray
6,443,834 B1 9/2002 Berger
6,468,147 B1 10/2002 Thomas
6,682,415 B1 1/2004 Vagedes
6,685,557 B1 * 2/2004 Hoffe ..... F24F 13/06 137/527.8
6,733,381 B1 5/2004 Ploeger
6,772,538 B2 8/2004 Vagedes
6,974,379 B2 12/2005 Koessler
7,074,124 B2 7/2006 Williams
D626,644 S 11/2010 Jacak et al.
7,988,544 B2 8/2011 Vanden Bosch et al.
8,056,673 B2 11/2011 Zelinski
8,721,410 B2 * 5/2014 Friebel ..... F24F 7/02 454/273
8,827,781 B2 * 9/2014 Aderman ..... A01K 1/0058 454/254
2009/0068630 A1 * 3/2009 Jardinier ..... F24F 11/047 434/358
2010/0011799 A1 1/2010 Sakakibara
2012/0149294 A1 * 6/2012 Labrecque ..... A01K 1/0052 454/353

* cited by examiner

VENT COVER

CROSS REFERENCE TO RELATED APPLICATION

The present invention claims the benefit of U.S. provisional application Ser. No. 61/889,825, filed Oct. 11, 2013, which is hereby incorporated herein by reference in its entirety.

FIELD OF THE INVENTION

The present invention relates generally to covers for vent openings, such as attic air vents formed in a downwardly-facing surface, such as a roof soffit.

BACKGROUND OF THE INVENTION

Vent openings are typically provided in roof soffits for venting air out of a building's attic space and/or for providing a fluid pathway through which air may enter the attic space from the outside environment. Other vent openings may be provided for venting pressurized air or other fluid from inside the building to the exterior, such as from a laundry dryer or an HVAC unit, in which vented air is routed through a conduit. Such vent openings are typically covered by a fixed grill with slots and louvers that continuously permit airflow between the outside environment and the building's attic, while preventing birds and other small animals from entering the building through the soffit vent cover. However, fixed grills are always open, and can permit small insects and the like to access the building's interior.

SUMMARY OF THE INVENTION

The vent cover of the present invention is attachable to an opening that is formed or established in a downwardly-facing surface, such as the soffit panel of a roof overhang, and substantially blocks access to the opening by birds, small animals, insects, and the like. The vent cover uses a dual-door system that opens when a sufficient outward flow of air is present, and closes under the force of gravity when little or no air is flowing out through the opening and vent cover. The dual-door system includes an outer door that is manually openable, independently from the inner door, so that even if an animal were to open the outer door, the inner door would remain in place to substantially block access to the vent cover and opening.

In one form of the present invention, a vent cover is provided for attachment to an opening formed or established in a downwardly-facing surface, such as a soffit. The vent cover includes a base portion, a housing, and a door. The base portion defines a base opening, and the housing is coupled to the base portion and extends downwardly therefrom. The housing defines a fluid discharge outlet, and a fluid passageway extends between the base opening and the fluid discharge outlet. The door has upper and lower end portions, with the upper end portion of the door being pivotably coupled to the housing or the base portion. The door is configured in a manner so that it is biased by gravity to a closed position in which the fluid discharge outlet is substantially closed by the door. The door may be biased to an open position, against the force of gravity, by a flow of fluid (such as air) that is discharged outwardly through the fluid discharge outlet. The door is configured to restrict access to an interior of the housing when it is in the closed position.

In one aspect, the door is configured so that when it is in the closed position, a center of gravity of the door is laterally offset from the upper end portion, so that a closing force is maintained by gravity on the door in the closed position.

In another aspect, the housing includes a bottom panel that is positioned below the door, so that the lower end portion of the door rests on the bottom panel when in the closed position.

In still another aspect, the aforementioned door is an outer door, and the vent cover further includes an inner door with upper and lower end portions. The upper end portion of the inner door is pivotably coupled to the housing or the base portion, and the inner door is biased by gravity to a closed position in which the fluid discharge outlet is substantially closed by the inner door. The inner door may be biased to an open position by a flow of fluid discharged outwardly through the fluid discharge outlet, and the inner door is configured to restrict access to an interior of the housing when in the closed position.

In a further aspect, the inner door and the outer door comprise respective hinge portions at their upper end portions. Optionally, the hinge portion of the inner door defines a first pivot axis, and the hinge portion of the outer door defines a second pivot axis, and the first and second pivot axes are substantially coaxial.

According to another form of the present invention, a vent cover is provided for attachment to a downwardly-facing surface, such as a soffit. The vent cover includes a base, a housing, and inner door, and an outer door. The housing is coupled to the base, which defines a base opening that permits airflow. The housing defines a fluid discharge outlet and a fluid passageway, the passageway extends between the base opening and the fluid discharge outlet. The inner and outer doors each have respective upper and lower end portions, with the upper end portions being pivotably coupled to the housing or the base. The inner and outer doors are both movable, together or independently, between a closed position in which the fluid discharge outlet is substantially blocked, and an open position in which the fluid discharge outlet is at least partially unblocked. When airflow is stopped or sufficiently reduced, the inner and outer doors are biased to their respective closed positions by gravity. The doors are selectively biased to their respective open positions, against the force of gravity, when a sufficient pressure or flow of fluid is directed outwardly through the fluid discharge outlet. In addition, the outer door is manually movable to its open position, while the inner door remains in its closed position, so that the inner door restricts access to an interior of the housing even when the outer door has been manually opened.

In one aspect, the inner and outer doors are both pivotable about a common pivot axis. Optionally, the inner door has a concave outer surface, and the outer door has a convex outer surface.

In another aspect, the base includes a collar portion that is configured to extend in to an opening that is formed in the downwardly-facing surface to which the vent cover is mounted. An inner surface of the collar portion defines the base opening.

In yet another aspect, the housing defines two fluid discharge outlets, and is arranged so that the fluid passageway is bifurcated to direct the flow of fluid outwardly through both the first and second fluid discharge outlets. Optionally, a second inner door and a second outer door are positioned at the second fluid discharge outlet, with the second set of inner and outer doors configured in substantially the same way as the corresponding inner and outer doors at the first fluid discharge outlet.

In still another aspect, the housing includes a pair of side panels spaced apart from one another, with a bottom panel coupled between the side panels. Optionally, the side panels are both substantially planar and are parallel to one another, and the bottom panel is generally in the shape of an inverted V.

In a further aspect, the base includes a generally planar base panel and a collar that extends upwardly from the base panel. The collar defines the base opening and is configured to extend in to the opening formed in the downwardly-facing surface to which the vent cover is mounted. The side panels extend downwardly from the planar base panel, and the bottom panel is spaced below the generally planar base panel.

Therefore, the vent cover of the present invention provides a self-closing and animal-resistant fluid discharge opening, which is operable to discharge air or other fluid through an opening formed in a surface, particularly a downwardly-facing surface such as a roof overhang soffit. The vent cover remains substantially or entirely closed when little or no air is flowing out of the vent, and opens itself when a sufficient flow of air (or other discharge fluid) is vented through the cover. Thus, even if a small animal is able to nudge or pull open the outer door of the cover, the inner door will remain closed to thereby limit or prevent access to the vent opening through the vent cover.

These and other objects, advantages, purposes and features of the present invention will become apparent upon review of the following specification in conjunction with the drawings.

DESCRIPTION OF THE PREFERRED EMBODIMENTS

Figure 1:
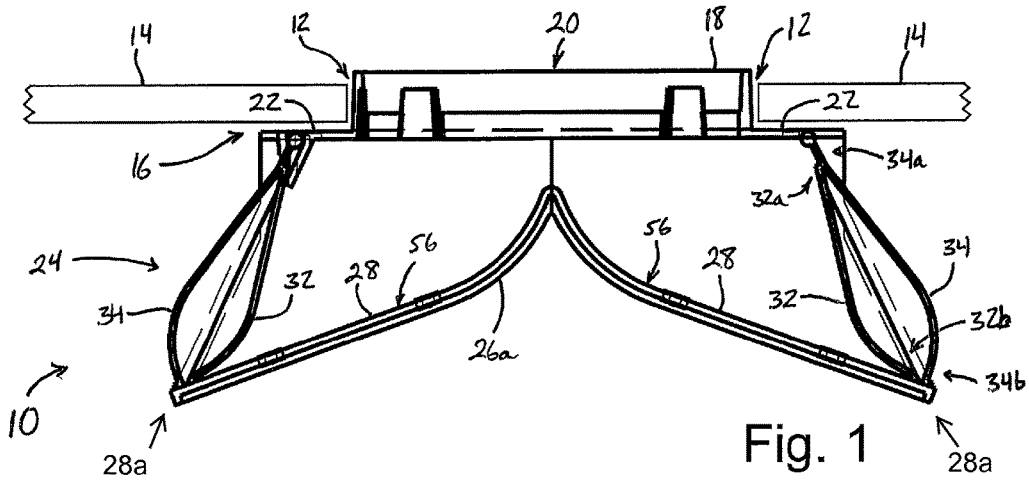
FIG. 1 is a side elevation of a vent cover in accordance with the present invention, in which both sets of doors are in their respective closed positions.
Figure 2:
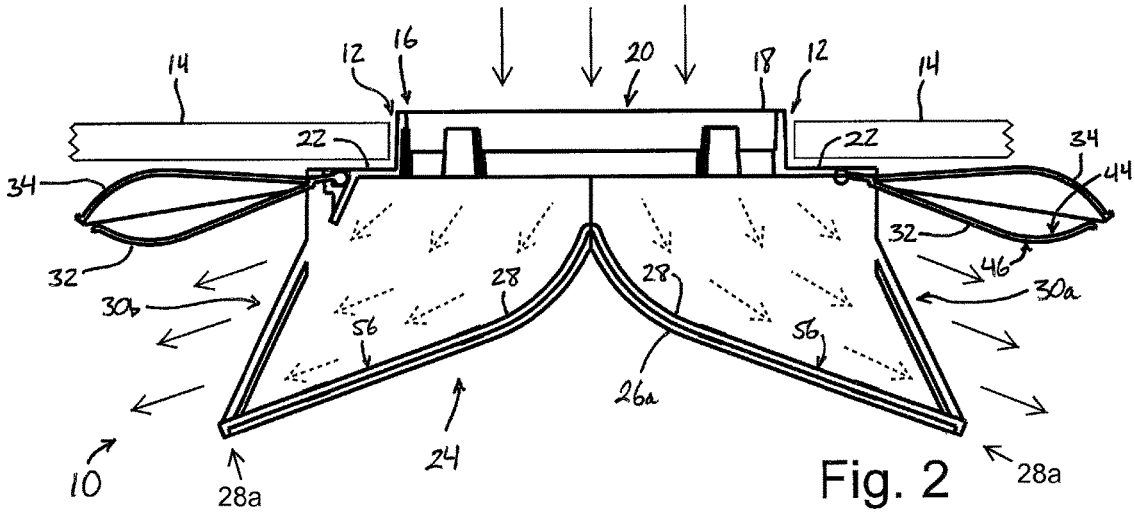
FIG. 2 is another side elevation of the vent cover of FIG. 1, in which both sets of doors are open during a discharge of air or fluid through the vent cover.
Figure 3:
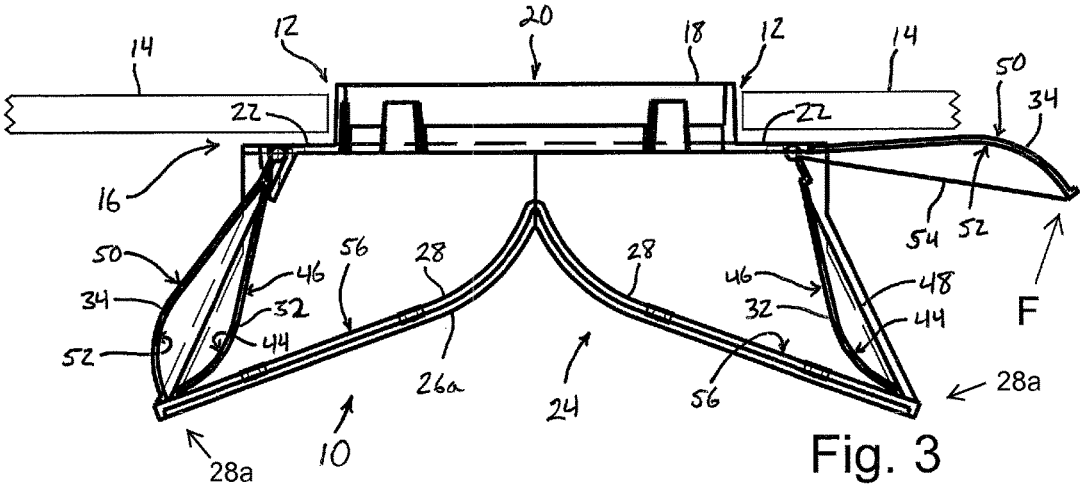
FIG. 3 is another side elevation of the vent cover of FIG. 1, in which one of the outer doors has been manually lifted to an open position.

Referring now to the drawings and the illustrative embodiments depicted therein, a vent cover assembly 10 is provided for covering and selectively discharging air or other flowable fluid through an opening 12 that is formed in a generally downwardly-facing surface 14, such as the soffit panel of a roof overhang or the like (FIGS. 1-3). Vent cover assembly 10 includes a base portion 16 with a collar 18 that defines a base opening 20. In addition, base portion 16 includes a generally planar base panel 22 from which collar 18 projects upwardly. A housing 24 is defined below base portion 16, and includes a pair of side panels 26*a*, 26*b* in spaced arrangement (FIGS. 4-6) and a housing lower portion in the form of a bottom panel 28 coupled between the side panels 26*a*, 26*b*. As best shown in FIG. 2, side panels 26*a*, 26*b*, bottom panel 28, and base panel 22 cooperate to define a pair of fluid discharge outlets 30*a*, 30*b*, which permit the flow of air or other fluid (designated by solid and dashed-line arrows in FIG. 2) to pass through base opening 20 and out of vent cover assembly 10.

Figure 4:
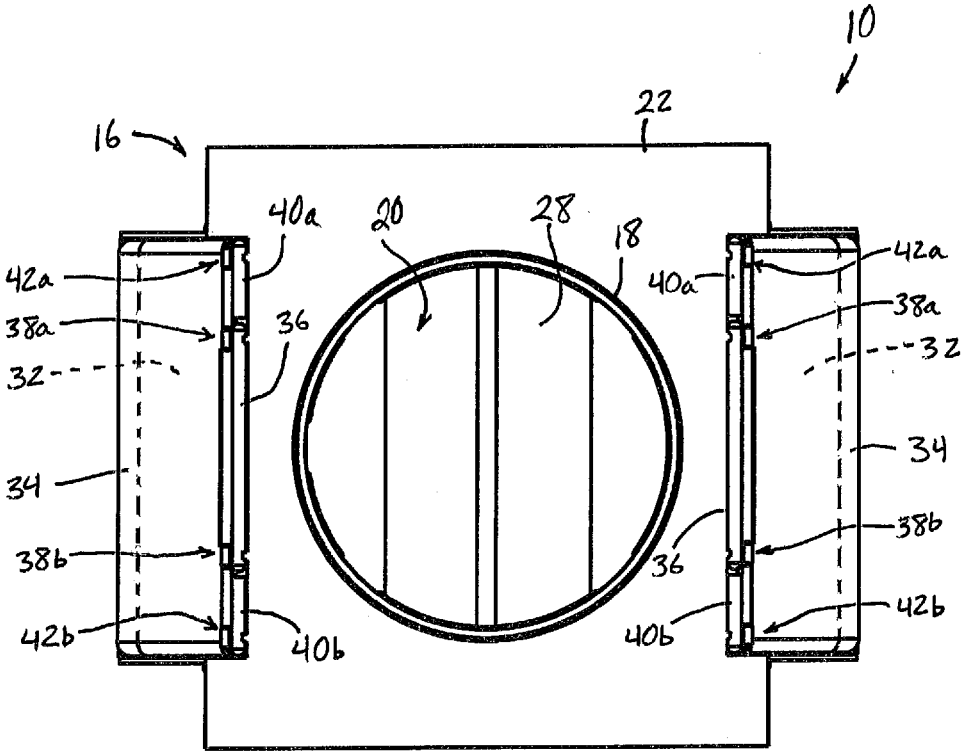
FIG. 4 is a top plan view of the vent cover of FIG. 1.
Figure 5:
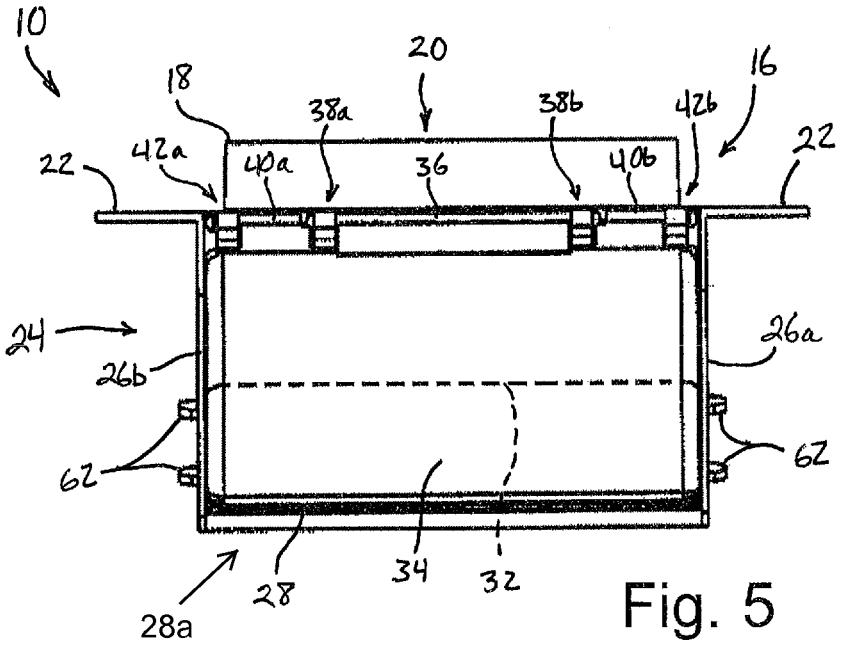
FIG. 5 is an end elevation of the vent cover of FIG. 1.
Figure 6:
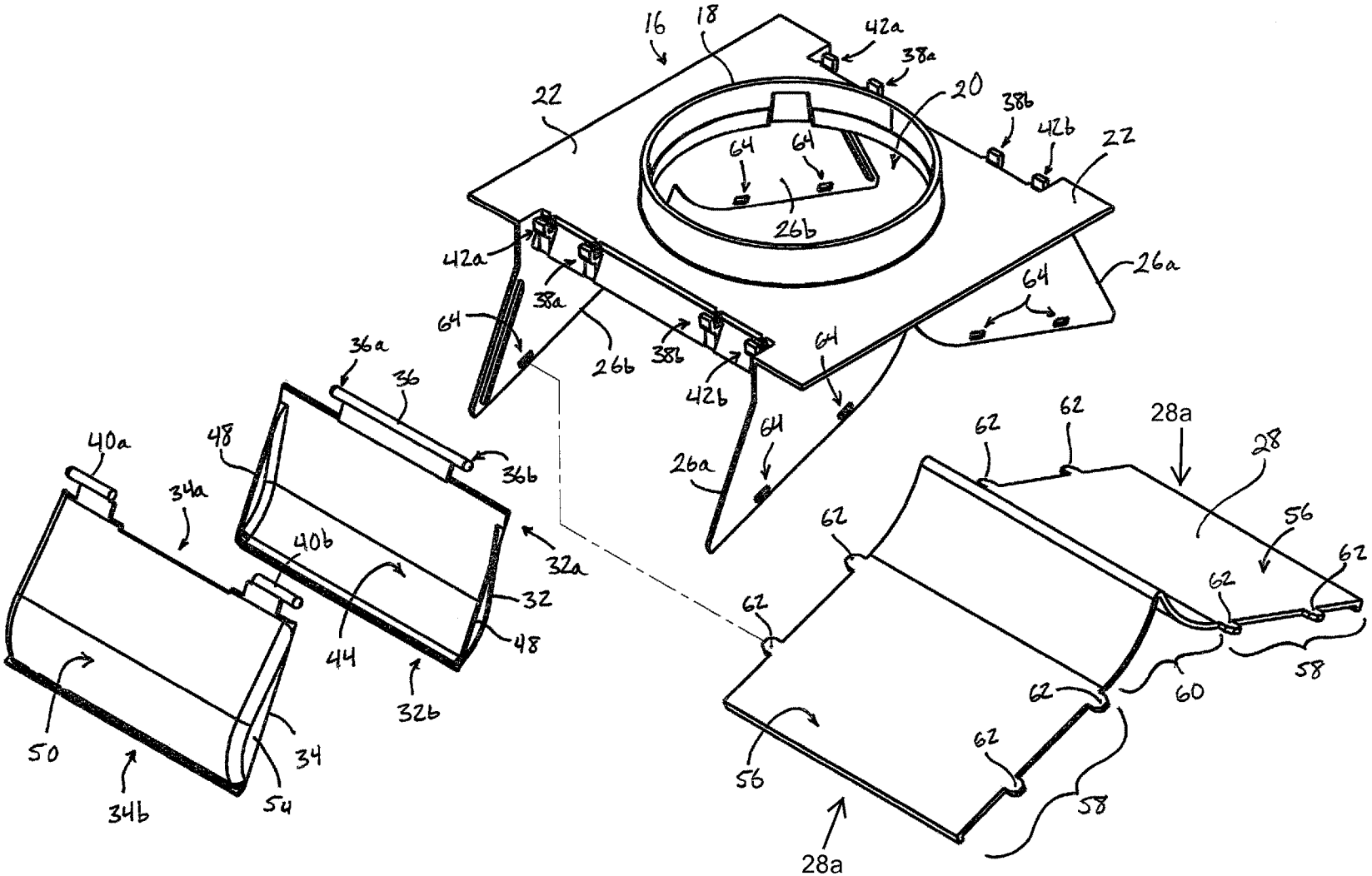
FIG. 6 is an exploded perspective view of portions of the vent cover.

Each fluid discharge outlet 30*a*, 30*b* is selectively covered by a respective pair of doors, including a pair of inner doors 32 and a pair of outer doors 34. Each door 32, 34 includes respective upper end portions 32*a*, 34*a*, and lower end portions 32*b*, 34*b* (FIGS. 1 and 6). Each door is pivotably mounted at its respective upper end portion 32*a*, 34*a* to base portion 16 via a hinge arrangement. As best shown in FIG. 6, inner door 32 includes a central hinge pin 36 at its upper end portion 32*a*. Hinge pin 36 has opposite end portions 36*a*, 36*b* that are received in respective inner hinge pin mounts 38*a*, 38*b* that are attached to base panel 22, such as shown in FIGS. 5 and 6. Each outer door 34 includes a pair of hinge pins 40*a*, 40*b*, which are received in respective outer hinge pin mounts 42*a*, 42*b* that are attached to base panel 22 and located outboard of inner hinge pin mounts 38*a*, 38*b*. Inner hinge pin mounts 38*a*, 38*b* and outer hinge pin mounts 42*a*, 42*b* define substantially identical (coaxial) pivot axes at each end of base portion 16. Outer hinge pins 40*a*, 40*b* are spaced apart from one another a sufficient distance so that central hinge pin 36 may be received between the outer hinge pins 40*a*, 40*b*, such as shown in FIGS. 4 and 5.

In the illustrated embodiment, inner doors 32 have outwardly-facing concave surfaces 44 and inwardly-facing convex surfaces 46, with a pair of opposite sidewalls 48 extending between upper end portion 32*a* and lower end portion 32*b* on the side of concave surfaces 44 (FIG. 6). Outer doors 34 include outwardly-facing convex surfaces 50 and inwardly-facing concave surfaces 52 (FIGS. 1-3), with a pair of opposite sidewalls 54 extending between upper end portion 34*a* and lower end portion 34*b* on the side of inwardly-facing concave surface 52, such as shown in FIG. 6. Optionally, the inner and outer doors may be shaped differently from what is shown and described herein, such as planar doors, doors having similar curvatures as one another, or the like, without departing from the spirit and scope of the present invention.

The shape of each door 32, 34 adds strength and stiffness to the doors, particularly compared to the alternative of a planar sheet having comparable outer dimensions and material thickness. It is also desirable that the outwardly-facing convex surfaces 50 of outer doors 34 do not form an airfoil or other shape that would be prone to lifting in the presence of relative wind in the ambient environment, since the lifting (and subsequent dropping) of the door(s) could create undesirable noise. Both doors 32, 34 are mounted so that their respective centers of gravity are laterally offset from the hinge points when the doors are in the closed position. This arrangement maintains a constant gravitational force in the direction of closing on each closed door, so that some of each door's weight is supported by bottom panel 28, and more than a negligible amount force is required to lift each door, whether due to airflow through the vent cover or due to manual lifting such as by a person or animal.

When doors 32, 34 are fully closed, their respective lower end portions 32*b*, 34*b* rest along an upper surface 56 of bottom panel 28, such as shown in FIGS. 1 and 3. Lower end portion 34*b* of outer door 34 terminates and rests at an outer end region 28*a* of bottom panel 28, which leaves little or no exposed area along outer end region 28*a*, where air escaping between lower end portion 34*b* and outer end region 28*a* can stagnate or become turbulent and cause airport dust particles, lint, etc. to build up in this area. Lower end portion 32*b* of inner door 32 is spaced somewhat inwardly from lower end portion 34*b* of outer door 34, when both doors are closed, so that lower end portion 32*b* cannot readily be lifted by an animal simultaneously with outer door 34. The inner doors' inwardly-facing convex surfaces 46 also increase the angle or degree of lift of both doors 32, 34 in response to an outflow of air through fluid discharge outlets 30*a*, 30*b*

At the same time, the sidewalls 48 of inner doors 32 lie in close proximity to inner surfaces of side panels 26*a*, 26*b*, while portions of sidewalls 54 of outer doors 34 also lie between side panels 26*a*, 26*b*, so that fluid discharge outlets 30*a*, 30*b* are substantially closed by doors 32, 34. Although each outer door 34 may be lifted separately by applying a manual force F (FIG. 3), only outboard edges of the sidewalls 48 and the outwardly-facing concave surfaces 44 of inner doors 32 are accessible when outer door 34 has been lifted. This makes it very difficult or substantially impossible for small animals to simultaneously raise both outer door 34 and inner door 32 to access the interior of vent cover assembly 10.

Bottom panel 28 is shaped generally as an inverted V, with substantially planar end portions 58 and a central inverted V portion 60. Inverted V portion 60 is shaped to split or bifurcate a flow of air or other fluid after it passes through base opening 20, such as shown in FIG. 2. Each planar end portion 58 includes four laterally-projecting tabs 62, which are arranged to align with corresponding slots or openings 64 that are formed along respective lower edge portions of side panels 26*a*, 26*b*. When assembling bottom panel 28 to side panels 26*a*, 26*b*, the side panels 26*a*, 26*b* may be flexed apart while aligning and inserting tabs 62 in slots 64. Releasing the side panels 26*a*, 26*b* allows them to return to their original substantially parallel alignment, with tabs 62 captured in corresponding slots 64.

This arrangement also allows the bottom panel 28 to be readily removed from the side panels 26*a*, 26*b*, such as to provide substantially unobstructed access to the interior of the housing 24 and base portion 16, as well as to any ductwork, plenums, etc. that may be associated with the vent opening 12, such as if a laundry dryer were vented to the building exterior via ductwork that routes discharged air to the vent opening. This facilitates cleaning out any accumulations of lint, dust, or other debris from the interior surfaces of the vent cover assembly and any ductwork or other fluid conduits associated with the vent, without the use of tools and without removing the entire vent cover assembly 10 from the vent opening 12. The removability of bottom panel 28 also provides better access to the interior surfaces of the vent cover assembly than would be possible through the opened doors 32, 34. After cleaning the interior of the vent cover assembly and/or any associated fluid conduits, bottom panel 28 may be readily replaced between the side panels 26*a*, 26*b* in the manner described above.

In the illustrated embodiment, base portion 16 and housing 24 are made from only two pieces, such as shown in FIG. 6, with base portion 16 and side panels 26*a*, 26*b* of housing 24 being unitarily formed of injected molded resinous plastic, for example. Bottom panel 28 may be formed as a single sheet of resinous plastic, such as by molding or cutting and forming from a planar sheet. Optionally, the various components of the vent cover assembly may be made from metal or other suitable materials.

In normal operation, inner doors 32 and outer doors 34 remain closed when the air or fluid pressure above vent cover assembly 10 (e.g., within the roof area of a building to which the vent cover assembly is mounted) is substantially equal to the ambient air pressure. However, when the air pressure above vent cover assembly 10 is increased to a sufficient level above the ambient, such as during high winds or due to operation of a vent fan or the like, air will be forced through base opening 20 and along a fluid passageway designated by dashed-line arrows in FIG. 2, to force the doors 32, 34 into partially-open or fully-open positions, depending on the rate of airflow. As the airflow decreases, gravity draws the doors 32, 34 downwardly to their fully-closed positions (FIGS. 1 and 5) in which fluid discharge outlets 30*a*, 30*b* are substantially closed to preclude access by small animals such as birds, insects, or the like.

It will be appreciated that the vent cover assembly may be configured with only one outlet and one set of doors, or with three or four outlets (e.g., in a Y pattern or an X pattern), and may also be altered in its dimensions to provide a desired size and shape, without departing from the spirit and scope of the present invention. For example, a lower-profile vent cover assembly could have the same discharge outlet area as that of the illustrated embodiment, by increasing the length dimension and decreasing the height dimension.

Thus, the vent cover assembly 10 limits or prevents access to a vent opening 12 via a dual door system in which an outer door may be manually lifted, but small animals are substantially prevented from also lifting an inner door in order to gain access to the interior of the vent cover assembly. As air pressure rises, such as during operation of a ventilation fan, air is forced outwardly through the vent cover assembly, thus lifting the doors and opening the fluid discharge outlets as long as there is sufficient air pressure and flow. As air pressure and flow decrease, the doors will close due to gravity, and again preclude access to the opening.

Changes and modifications in the specifically-described embodiments may be carried out without departing from the principles of the present invention, which is intended to be limited only by the scope of the appended claims as interpreted according to the principles of patent law including the doctrine of equivalents.

The embodiments of the invention in which an exclusive property or privilege is claimed are defined as follows:

1. A vent cover for attachment to a downwardly-facing surface, said vent cover comprising:

a base portion defining a base opening;

a housing coupled to said base portion and extending downwardly therefrom, said housing defining a fluid discharge outlet and a fluid passageway extending between said base opening and said fluid discharge outlet, wherein said housing comprises a housing lower portion that defines a portion of said fluid discharge outlet;

an outer door having upper and lower end portions, wherein said upper end portion of said outer door is pivotably coupled to said housing or said base portion and is pivotable between a closed position in which said lower end portion rests against said housing lower portion and an open position in which said lower end portion is spaced above said housing lower portion, wherein said outer door is biased by gravity to the closed position; and an inner door having upper and lower end portions, wherein said upper end portion of said inner door is pivotably coupled to said housing or said base portion, said inner door is biased by gravity to a closed position in which said fluid discharge outlet is substantially closed by said inner door, and said inner door is configured to move to an open position in response to a flow of fluid discharged outwardly through said fluid discharge outlet;

wherein when said inner door is in its closed position said outer door is manually movable to its open position, and when said outer door is in its closed position, said outer door inhibits access to said inner door.

2. The vent cover of claim 1, wherein said inner and outer doors each have a respective center of gravity that is laterally offset from said respective upper end portion in both the open position and the closed position.

3. The vent cover of claim 2, wherein said housing comprises a pair of side panels in spaced arrangement, and said housing lower portion comprises a bottom panel positioned between said side panels.

4. The vent cover of claim 1, wherein said inner door and said outer door comprise respective hinge portions at their upper end portions, and wherein said hinge portion of said inner door defines a first pivot axis, and said hinge portion of said outer door defines a second pivot axis, and where said first and second pivot axes are substantially coaxial.

5. The vent cover of claim 1, wherein said inner door comprises a concave outer surface facing said outer door, and said outer door comprises a convex outer surface facing away from said inner door.

6. The vent cover of claim 1, wherein said base portion comprises a collar that is configured to extend into an opening formed in the downwardly-facing surface, and wherein an inner surface of said collar defines said base opening.

7. The vent cover of claim 1, wherein said fluid discharge outlet comprises a first fluid discharge outlet, and wherein said housing defines a second fluid discharge outlet, whereby said fluid passageway is bifurcated to direct the flow of fluid outwardly through said first and second fluid discharge outlets, said vent cover further comprising a second inner door and a second outer door at said second fluid discharge outlet, wherein said second inner door and said second outer door are operable in the same manner as corresponding ones of said inner door and said outer door of said first fluid discharge outlet.

8. The vent cover of claim 7, wherein said housing comprises a pair of side panels in spaced arrangement, and wherein said housing lower portion comprises a bottom panel coupled between said side panels.

9. The vent cover of claim 8, wherein said side panels are substantially parallel to one another, and wherein said bottom panel comprises an inverted V shape.

10. The vent cover of claim 9, wherein said base portion comprises a base panel and a collar that extends upwardly from said base panel, wherein said collar defines said base opening and is configured to extend into the opening formed in the downwardly-facing surface, and wherein said side panels extend downwardly from said base panel.

11. A vent cover for attachment to a downwardly-facing surface, said vent cover comprising:

a base portion defining a base opening;

a housing coupled to said base portion and extending downwardly therefrom, said housing defining a fluid discharge outlet and a fluid passageway extending between said base opening and said fluid discharge outlet, wherein said housing comprises a housing lower portion that defines a portion of said fluid discharge outlet;

a door having upper and lower end portions, wherein said upper end portion of said door is pivotably coupled to said housing or said base portion and is pivotable between a closed position in which said lower end portion rests against said housing lower portion and an open position in which said lower end portion is spaced above said housing lower portion; and wherein said door is biased by gravity to the closed position in which said fluid discharge outlet is substantially closed by said door, said door is movable to the open position by a flow of fluid discharged outwardly through said fluid discharge outlet, and said door is configured to restrict access to the fluid passageway when in the closed position;

wherein said housing comprises a pair of side panels in spaced arrangement, and wherein said housing lower portion comprises a bottom panel coupled between said side panels; and wherein said bottom panel comprises a plurality of outwardly-directed tabs and said side panels define a plurality of openings configure to receive respective ones of said tabs for attaching said bottom panel to said side panels.

12. The vent cover of claim 11, wherein said base portion comprises a base panel and a collar that extends upwardly from said base panel, wherein said collar defines said base opening and is configured to extend into the opening formed in the downwardly-facing surface, and wherein said side panels extend downwardly from said base panel.

13. The vent cover of claim 12, wherein said base panel, said collar, and said side panels are unitarily formed.

14. A vent cover for attachment to a downwardly-facing surface, said vent cover comprising:

a base portion defining a base opening;

a housing coupled to said base portion and extending downwardly therefrom, said housing defining a fluid discharge outlet and a fluid passageway extending between said base opening and said fluid discharge outlet, wherein said housing comprises a pair of side panels in spaced arrangement and a housing lower portion that defines a portion of said fluid discharge outlet;

an outer door and an inner door positioned inboard of said outer door relative to said fluid passageway, said outer and inner doors having respective upper and lower end portions, wherein said upper end portions of said outer and inner doors are pivotably coupled to said housing or said base portion, wherein said outer and inner doors are pivotable between closed positions in which said lower end portions rest against said housing lower portion and open positions in which said lower end portions are spaced above said housing lower portion; and wherein said outer and inner doors are each biased by gravity to the closed positions in which said fluid discharge outlet is substantially closed by said outer and inner doors, said outer and inner doors are movable to the open positions by a flow of fluid discharged outwardly through said fluid discharge outlet, said outer door is manually movable to the open position when said inner door is in the closed position, and when said outer door is in its closed position, said outer door inhibits access to said inner door.

15. The vent cover of claim 14, wherein said inner door and said outer door comprise respective hinge portions at their respective upper end portions, and wherein said hinge portion of said inner door defines a first pivot axis, and said hinge portion of said outer door defines a second pivot axis, and where said first and second pivot axes are substantially coaxial.

16. The vent cover of claim 14, wherein said inner door is configured to restrict access to the fluid passageway when said inner door in in the closed position and said outer door is in the open position.

17. The vent cover of claim 16, wherein said inner door comprises a concave outer surface facing said outer door, and said outer door comprises a convex outer surface facing away from said inner door.

18. The vent cover of claim 14, wherein said base portion comprises a base panel and a collar that extends upwardly from said base panel, wherein said base panel, said collar, and said side panels are unitarily formed, and wherein said housing lower portion comprises a plurality of outwardly-directed tabs and said side panels define a plurality of openings configure to receive respective ones of said tabs for attaching said housing lower portion to said side panels.

19. The vent cover of claim 14, wherein said fluid discharge outlet comprises a first fluid discharge outlet, and wherein said housing defines a second fluid discharge outlet, whereby said fluid passageway is bifurcated to direct the flow of fluid outwardly through said first and second fluid discharge outlets, said vent cover further comprising a second inner door and a second outer door at said second fluid discharge outlet, wherein said second inner door and said second outer door are operable in substantially the same manner as corresponding ones of said inner door and said outer door of said first fluid discharge outlet.

* * * * *